US005340306A

United States Patent [19]

Keller et al.

[11] Patent Number: 5,340,306

[45] Date of Patent: Aug. 23, 1994

[54] DEVICE FOR MIXING TWO GASEOUS COMPONENTS AND BURNER IN WHICH THIS DEVICE IS EMPLOYED

[75] Inventors: Jakob Keller, Redmond; Robert E. Breidenthal, Seattle, both of Wash.

[73] Assignee: Asea Brown Boveri Ltd., Baden, Switzerland

[21] Appl. No.: 985,316

[22] Filed: Dec. 4, 1992

[30] Foreign Application Priority Data

Dec. 23, 1991 [EP] European Pat. Off. ..... 91122141.4

[51] Int. Cl.[5] ..... F23C 5/00

[52] U.S. Cl. ..... 431/351; 431/354; 431/8; 431/10

[58] Field of Search ..... 431/350, 173, 8, 9, 431/10, 354, 351; 239/403, 424.5, 431, 498, 553.5

[56] References Cited

U.S. PATENT DOCUMENTS

| | | | |
|---|---|---|---|
| 1,437,201 | 11/1922 | Schumann | 239/431 |
| 2,464,791 | 3/1949 | Bonvillian et al. | 431/173 |
| 2,778,327 | 1/1957 | Sifrin et al. | 431/173 |
| 3,455,108 | 7/1969 | Clare et al. | 60/749 |
| 3,618,318 | 11/1971 | Bryce | 60/749 |

FOREIGN PATENT DOCUMENTS

| | | | |
|---|---|---|---|
| 0031206 | 7/1981 | European Pat. Off. . | |
| 0321809 | 6/1989 | European Pat. Off. . | |
| 224911 | 7/1925 | United Kingdom | 239/431 |

*Primary Examiner*—Carl D. Price

*Attorney, Agent, or Firm*—Oblon, Spivak, McClelland, Maier & Neustadt

[57] ABSTRACT

A device for mixing two gaseous components, particularly in the context of a burner in which it is desired to mix the two gaseous components prior to combustion. The device includes a tangential inlet flow duct which opens into an inlet flow gap. A first gaseous component flows in through this inlet flow gap, and a second gaseous component flows through inlet flow nozzles provided in the region of the inlet flow gap. The arrangement achieves particularly intimate mixing, such that an improved burner is provided. Ramps are disposed in the region of the inlet flow duct, with the ramps including an end having a separation edge in the inlet flow gap. The inlet flow nozzles are arranged in the region around the separation edge such that mixing is promoted by longitudinal vortices occurring in the region.

16 Claims, 2 Drawing Sheets

DEVICE FOR MIXING TWO GASEOUS COMPONENTS AND BURNER IN WHICH THIS DEVICE IS EMPLOYED

BACKGROUND OF THE INVENTION

1. Field of the Invention

The invention is based on a device for mixing two gaseous components in accordance with the preamble to claim 1 and of a burner in accordance with the preamble to claim 7.

2. Discussion of the Background

A burner with two partial conical bodies is known from the patent specification EP 0 321 809. This burner has two tangentially directed inlet flow gaps for air. Liquid fuel is admixed with the air in the region of the inlet flow gaps by means of inlet flow nozzles. This burner does not have an optimum configuration for the admixture of gaseous fuels.

SUMMARY OF THE INVENTION

Accordingly, one object of this invention is to provide aid in this respect. The invention, as specified in the independent claims, achieves the object of creating a device for mixing two gaseous components, the device leading to particularly intimate and uniform mixing, and of providing a burner whose ability to generate a primary temperature distribution which is as even as possible is advantageously increased by this device.

The advantages achieved by the invention may be seen essentially in the fact that particularly rapid mixing of the two components can be achieved by simple measures in the region of the supply flow of one of the gaseous components. If this device is employed in a burner of the type described, particularly uniform mixing of the combustion air with the gaseous fuel is achieved before initiation of the reaction and the result of this is a very good combustion characteristic, the appearance of undesirable combustion products such as $NO_x$ being, in particular, advantageously reduced. Furthermore, the fuel is better utilized so that the occurrence of unsaturated hydrocarbon compounds and carbon monoxide is suppressed.

The further embodiments of the invention are the object matter of the dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings (which only represent one possible embodiment path) wherein.

DESCRIPTION OF THE PREFERRED EMBODIMENTS

Figure 1:
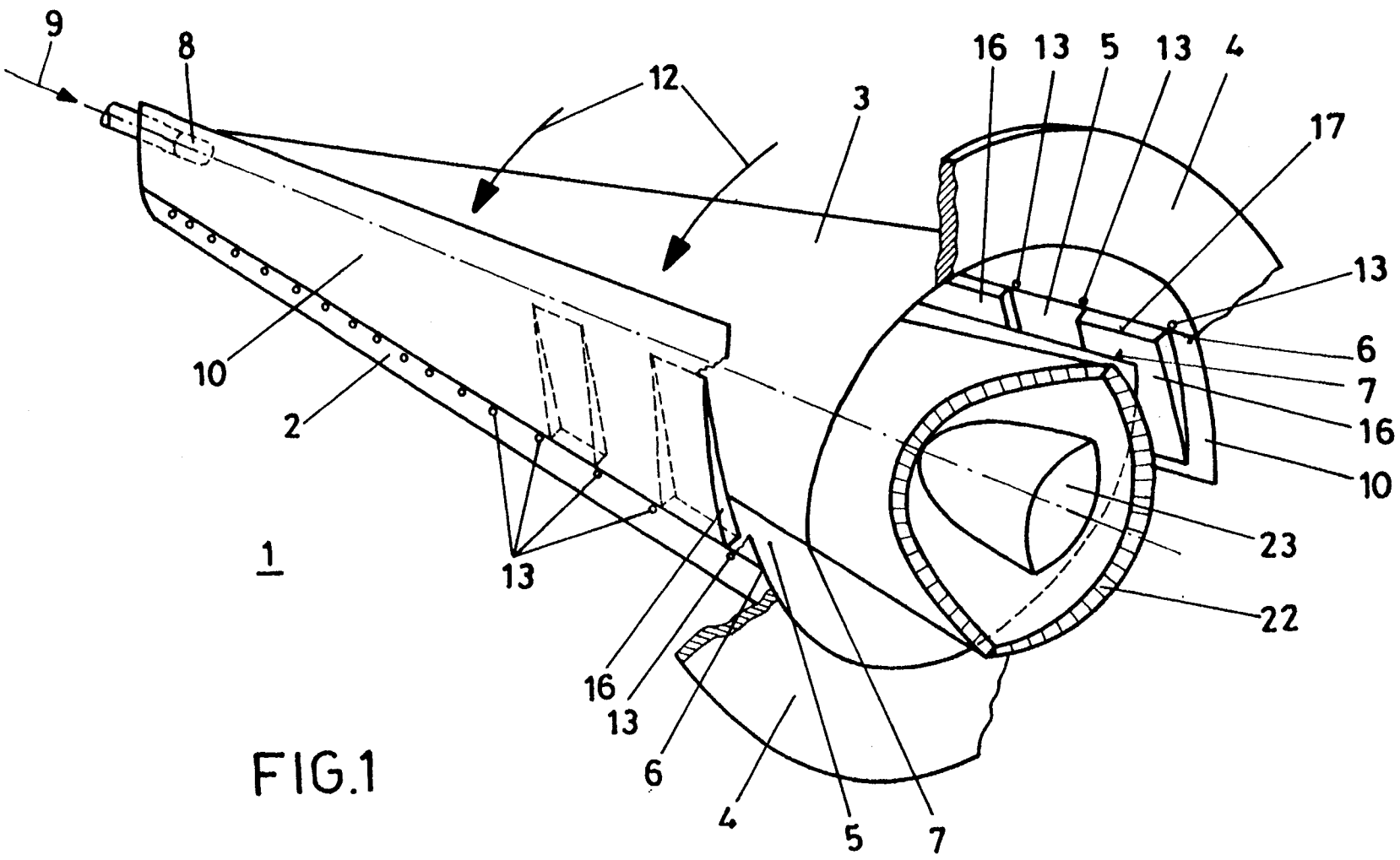
FIG. 1 shows a first embodiment of the invention

Referring now to the drawings, wherein like reference numerals and letters designate identical or corresponding parts throughout the several views, FIG. 1 shows one of the burners 1 of a gas turbine installation in a diagrammatic, very simplified, perspective view. This burner 1 can also be employed in other installations in which hot gases are generated. The burner 1 consists of two hollow partial conical bodies 2, 3 whose parallel central axes are offset relative to one another in a radial direction. At the end of the burner, a collar 4, which is only partially shown, connects the partial conical bodies 2, 3 together. The other holding devices for the burner 1, and also the supply flow ducts for the combustion air, are not shown for ease of understanding. Because of the offset between the partial conical bodies 2, 3, two inlet flow gaps 5 respectively occur between an outer edge 6 and an inner edge 7 adjacent to it of the partial conical bodies 2, 3. The two partial conical bodies 2, 3, respectively, have the see included angle. In the region of the apexes of the partial conical bodies 2, 3, there is a burner nozzle 8, indicated by an arrow 9 which shows the supply of liquid fuel to the burner nozzle 8. The burner 1 can also be operated, however, without feeding the burner nozzle 8.

Figure 2:
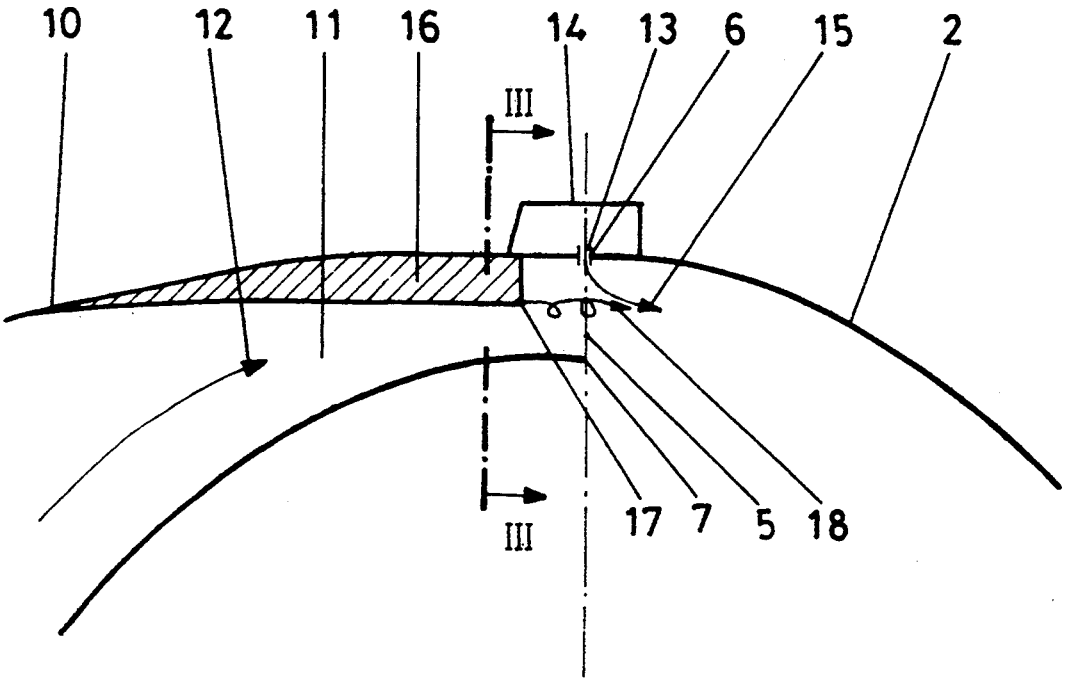
FIG. 2 shows a diagrammatic partial section through the arrangement of FIG. 1

A guide plate 10 is joined, usually rigidly, to each of the outer edges 6. It is, however, also conceivable for this guide plate 10 to be adjustably attached. An inlet flow duct 11, which opens into the inlet flow gap 5, is formed between each guide plate 10 and the opposite outer wall of the corresponding partial conical body 2 or 3. The path of the inlet flow duct 11 is shown diagrammatically in FIG. 2. Arrows 12 indicate the inlet flow of the combustion air, which flows almost tangentially through the inlet flow gap 5 into the inside of the partial conical body 2, 3. The rest of the combustion air supply system is not shown. Inlet flow nozzles 13 are provided along the outer edge 6 for introducing gaseous fuel or fuel prepared in gaseous form into the region of the inlet flow gap 5. The associated fuel supply duct, which is located at the outside on the burner 1, is not shown in FIG. 1 for ease of understanding but the fuel supply duct 14 is shown in FIG. 2. An arrow 15 gives the flow direction of the entering gaseous fuel in FIG. 2.

As may also be seen in FIG. 1 and 2, ramps 16 are attached to the guide plates 10 in the inlet flow duct 11. The ramps become thicker in the direction of the combustion air flowing into the inlet flow gap 5 and end with a separation edge 17 in front of the inlet flow gap 5. The inlet flow nozzles 13 are located in the region near and/or after the separation edge 17 of the ramps 16. The inlet flow nozzles 13 are located in the region between one and approximately five times the hydraulic diameter of the ramps 16. In addition, the distance between the inlet flow nozzles 13 and the separation edge 17 is relatively large compared with the diameter of the inlet flow nozzles 13. The eddying flow of the combustion air separating from the separation edge 17 is shown by an arrow 18 in FIG. 2. The ramps 16 extend into the inlet flow duct 11 over a length which corresponds approximately to between three and five times the height of the inlet flow gap 5. The same dimension is also the minimum length of the inlet flow duct 11 but an extension of the inlet flow duct 11 beyond this minimum dimension can introduce a flow improvement.

In FIG. 1, only two ramps 16 are provided on each of the guide plates 10. It is, however, advantageous to provide the whole length of the guide plates 10 with such ramps 16 in order to achieve good mixing between the gaseous fuel and the entering combustion air in the narrower part of the burner also. It is also possible to provide only part of the burner 1—the part adjacent to the outlet into the combustion chamber—with ramps 16 because particularly good mixing between the gaseous fuel and the combustion air is important in this region.

Figure 3:
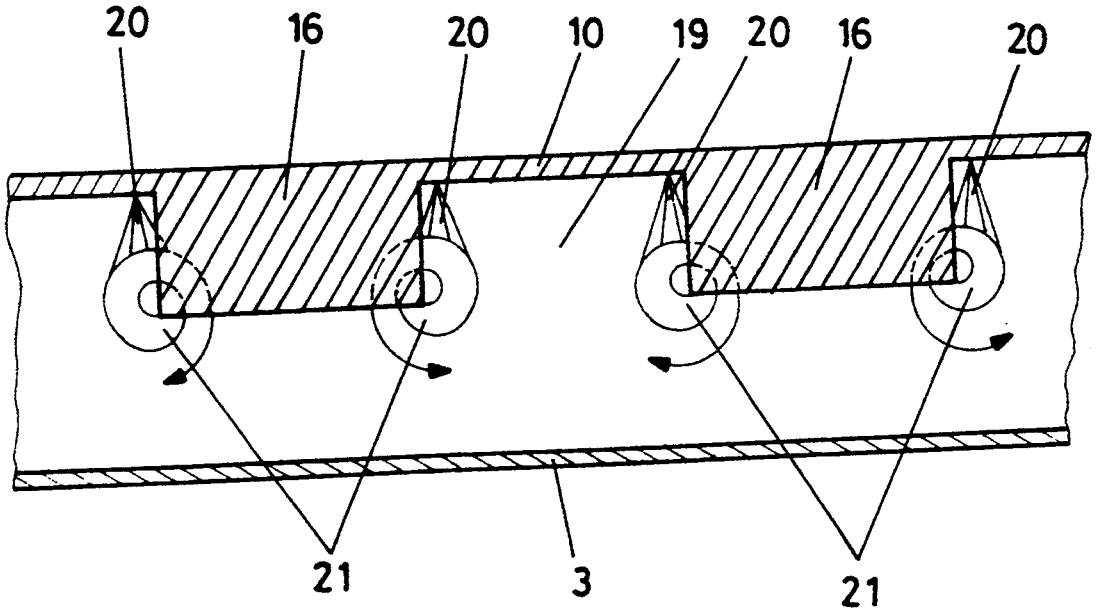
FIG. 3 shows a further diagrammatic partial section.

The section III—III of FIG. 2 is shown in FIG. 3. An intermediate space 19 is respectively provided between the ramps 16 and is of approximately the same width as the ramps. Fuel jets 20 indicate the region behind the section plane in which the inlet flow nozzles 13 introduce the gaseous fuel. Diagrammatically sketched vortices 21 show the points where the entering combustion air eddies most strongly. The vortices generated by the ramps 16 are intended to reinforce the momentum of the fuel jets 20. For this reason, the inlet flow nozzles 13 for the fuel inlet are arranged in such a way that the fuel reaches the region of the maximum air velocity components directed radially inwards in the region of the vortex 21. The width of the intermediate spaces 19 does not have to correspond to the width of the ramps 16 in all applications. The optimum mixing conditions can be adjusted from case to case when the burner is optimized for particular uses. It is, therefore, also possible to configure burners in such a way that the width of the ramps 16 increases in the burner outlet direction.

The mixing can also be influenced by the height of the separation edge 17. In general, the separation edge has a height between approximately 25% and approximately 50% of the height of the inlet flow gap 5. These figures can also be optimized to suit the particular use of the burner. The ramps 16 can also, however, be replaced or supplemented by similarly acting milled recesses in the guide plate 10 and this variant could be advantageously selected, particularly to improve existing installations.

It is not just for the mixing of two gaseous components in burners or similar devices, as described in the embodiment example, that the device according to the invention can be advantageously employed. It can also be employed wherever a particularly intimate mixing of two gases is demanded. The intimate mixing of different vapors, or even vapors and gases, is also conceivable by means of this device.

FIGS. 1 to 3 are considered in somewhat more detail in order to explain the mode of operation. The gaseous fuel entering through the inlet flow nozzles 13 is mixed with the combustion air. The momentum of the jets of the high calorific value fuel entering is not sufficient for intimate mixing between the two components, nor is it possible to increase this momentum with reasonable technical outlay. The ramps 16, with the separation edge 17, in the inlet flow duct 11 generate a specific arrangement of longitudinal vortices in the inlet flow gap 5, as is indicated by the arrow 18 and the vortex 21. These longitudinal vortices meet the fuel jets 20, entrain the gaseous fuel and ensure optimum mixing of the fuel with the combustion air. The actual combustion takes place in the known flame front 22 of this type of burner. A reverse flow zone 23 also forms and this stabilizes the flame front 22. The intimate mixing of the fuels with the combustion air in this burner leads to combustion with very little thermal generation of $NO_x$ and good utilization of the energy content of the fuels.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for mixing two gaseous components, having a tangential inlet flow duct which opens into a first inlet flow gap of a pair of inlet flow gaps through which the first of the two components enters, said pair of inlet flow gaps defined by at least two hollow partial conical bodies having central axes which are offset relative to one another, the device further including inlet flow nozzles in the region of the inlet flow gap, through which nozzles the second of the two components is supplied wherein:

in the region of the inlet flow duct, individual ramps are provided, said individual ramps having a thickness which increases in a first direction, with said first direction extending along said inlet flow duct and toward said first inlet flow gap such that said ramps become thicker toward the inlet flow gap and wherein said ramps end in the first inlet flow gap at a separation edge; and the inlet flow nozzles are located in a region near the separation edge of the ramps.

2. The device as claimed in claim 1, wherein the inlet flow nozzles are located in a region downstream from the separation edge of the ramps.

3. The device as claimed in claim 1, wherein the inlet flow nozzles are in a region located downstream of said ramps, said region extending between one and five times a hydraulic diameter of the ramps.

4. The device as claimed in claim 1, wherein a distance extending between the inlet flow nozzles and the separation edge is large compared with a diameter of the inlet flow nozzles.

5. The device as claimed in claim 1, wherein:

the ramps extend over a length which corresponds to between three and five times a height of the inlet flow gap, said height extending between said two hollow partial conical bodies and in a direction perpendicular to a tangential direction, and the separation edge has a height between 25% and 50% of the height of the inlet flow gap.

6. The device as claimed in claim 5, wherein:

the inlet flow duct extends over at least a length corresponding to between three and five times the height of the inlet flow gap.

7. Device as claimed in claim 1, wherein the first of the two gaseous components is mainly combustion air; and the second of the two gaseous components is a gaseous fuel or a fuel prepared in gaseous form.

8. The device of claim 1, wherein said inlet flow gaps are in communication with a flame front at which combustion takes place, such that a burner is provided which receives said two gaseous components after mixing.

9. The device of claim 1, wherein at least one ramp is disposed within each of said pair of inlet flow gaps.

10. The device of claim 9, wherein a pair of inlet flow ducts are provided, and wherein a guide plate is attached to an outer edge of each inlet flow gap and forms an outer wall of the tangentially directed inlet flow ducts, and wherein the guide plates provide a support for the ramps.

11. The device of claim 10, wherein a plurality of said ramps are provided in each of said inlet flow gaps, and wherein said ramps are spaced in a lengthwise direction such that intermediate spaces between adjacent ramps have a width which is substantially the same as a width of the ramps in said lengthwise direction.

12. The device of claim 9, wherein a plurality of said ramps are provided in each of said inlet flow gaps and said inlet flow gaps are in communication with a flame front at which combustion takes place, and wherein ramps disposed closer to the flame front have a width greater than ramps remote from said flame front.

13. A burner including a device for mixing tow gaseous components comprising:

an inlet flow duct;

a pair of hollow partial conical bodies having central axes which are offset relative to one another, said pair of hollow partial conical bodies defining a pair of inlet flow gaps, and wherein one of said inlet flow gaps is connected to said inlet flow duct to receive the first of the two components after the first of said two components passes through said inlet flow duct;

wherein at least one ramp is disposed at least partially in said inlet flow duct, said ramp having a thickness which is smaller at a first location and greater at a second location, and wherein said second location is closer to said one of said inlet flow gaps than said first location;

said at least one ramp including a separation edge at said second location which defines an end of said at least one ramp; and a plurality of inlet flow nozzles introducing the second of said two gaseous components, wherein said inlet flow nozzles are located in a region near the separation edge of said at least one ramp.

14. The burner of claim 13, wherein a guide plate extends from one of said hollow partial conical bodies such that said guide plate defines said inlet flow duct, and wherein said at least one ramp is mounted upon said guide plate.

15. The burner of claim 13, wherein a plurality of said ramps are provided in said inlet flow duct.

16. The burner of claim 13, wherein a pair of said inlet flow ducts are provided respectively for said pair of inlet flow gaps, and further wherein at least one ramp is disposed in each of said inlet flow ducts.

* * * * *